United States Patent [19]

Bramley

[11] 3,994,662

[45] Nov. 30, 1976

[54] APPARATUS FOR THE MANUFACTURE OF NETTING

[76] Inventor: Anthony Bramley, Gosford House, Gosford, Kidlington, Oxfordshire, England

[22] Filed: Aug. 13, 1975

[21] Appl. No.: 604,144

[30] Foreign Application Priority Data

Aug. 20, 1974 United Kingdom..... 36598/74

[52] U.S. Cl...... 425/500; 425/510; 425/111; 425/455 R; 140/112

[51] Int. Cl.[2]..... B29C 27/00

[58] Field of Search ..... 425/502, 510, 455, 516, 425/382 N, 500, 111; 140/112

[56] References Cited

UNITED STATES PATENTS

| | | | |
|---|---|---|---|
| 1,915,184 | 6/1933 | Cosgrove | 140/112 |
| 2,368,047 | 1/1945 | Southwick | 140/112 |
| 2,401,319 | 6/1946 | Roemer | 140/112 X |
| 2,451,423 | 10/1948 | Wickwire | 140/112 |
| 3,515,177 | 6/1970 | Gott et al. | 140/112 |
| 3,825,163 | 7/1974 | Versteeg | 140/112 X |

*Primary Examiner*—Robert L. Spicer, Jr.
*Attorney, Agent, or Firm*—Woodhams, Blanchard and Flynn

[57] ABSTRACT

Netting is made from thermoplastic threads on a machine which applies to a plurality of spaced longitudinal strands at least two spaced transverse strands and bonds the latter to the former by individual moulded masses of plastics material. The rows of die assemblies for this moulding operation are arranged in one or more oppositely directed pair and are supplied with transverse strands by drawing such strands across the longitudinal strands and then transferring the required lengths of strand laterally into the respective die assemblies from opposite directions. The longitudinal strands are advanced intermittently by cooperating grippers, preferably at both ends of the machine. Sets of releasable grippers at the input and the output ends of the machine are reciprocable between positions respectively upstream and downstream of other sets of releasable grippers at the ends of the machine. Synchronized movement of the grippers then ensures that constant lengths of the longitudinal strands are advanced at constant tension in each cycle.

6 Claims, 8 Drawing Figures

APPARATUS FOR THE MANUFACTURE OF NETTING

This invention relates to the manufacture of netting and more particularly it relates to the manufacture of rectilinear netting.

In British Pat. No. 1,110,793 there is described and claimed netting composed of regularly and preferably rectilinearly arranged flexible threads which consist of or contain thermoplastic filaments, the thread being joined to one another to form netting by masses of plastics material individually moulded and bonded to each thread at each thread junction. The specification also describes and claims a method of making the netting, and apparatus suitable for performing the method.

British Pat. No. 1,321,229 is concerned to counteract the contraction of the overall length of the transverse strands which occurs on the moulding of the plastics masses, and claims apparatus for producing netting which comprises means for advancing a plurality of longitudinal threads, means for drawing at least one transverse thread across the longitudinal threads, a transverse row of openable die assemblies each adapted to receive and enclose portions of one longitudinal and one transverse thread at a thread crossing, means for introducing a heated plastics material into the die assemblies to form a moulded mass therein, and thread diverting means arranged to extend the path of a transverse thread between adjacent die assemblies to counteract the contraction of the transverse thread which occurs on the introduction of the heated plastics material.

The netting of the type to which this specification relates is usually made in a cyclic process in which a transverse thread is drawn across at least two spaced longitudinal threads, each crossing of a longitudinal thread and the transverse thread is enclosed in a die assembly, quantities of heated plastics material of a moulding consistency are severally injected into the die assemblies to form a bond between the longitudinal and transverse threads and the bonded portions are removed from the die assemblies by longitudinal movement of the longitudinal threads, this cycle of operations being performd repeatedly along the length of the longitudinal threads.

One way of increasing the rate of production of netting by this method is to bond more than one transverse strand in a single cycle and mention is made of this possibility in U.S. Pat. No. 1,110,793. Numerous difficulties are, however, encountered in putting this idea into practice. One particular difficulty is that the die assemblies and means for injecting the heated plastics materials are relatively large and cumbersome items of equipment and tend to obstruct the action of the means for supplying the transverse strands to the die assemblies.

A further problem which arises in the manufacture of netting in the manner described is that of accurately supplying transverse strands to the moulding dies at high operational speeds, which calls for improved feed means for the transverse strands.

A still further problem is that of providing satisfactory drawing or take-up means for the longitudinal strands, which will be capable of advancing the strands to the dies and the formed netting from the dies without undesirable tension variations. The production of an even product of regular mesh size requires equal tension in all the longitudinal strands and preferably also constant tension throughout the process. The establishment of these conditions is a matter of some difficulty. Strand tensioners of conventional design can be employed in the apparatus but are difficult to adjust accurately and cannot allow for variations in, for example, the degree of twist in the longitudinal strands, which in turn affects the tension. The problem becomes more acute in longer machines with more rows of die assemblies, where the tension necessary may become excessive, or with unduly extensible strands, such as braided strands.

According to a first aspect of this invention there is provided apparatus for producing rectilinear netting which comprises: means for advancing a plurality of spaced longitudinal strands in a downstram direction; a pair of transverse rows of die assemblies for moulding individual masses of plastics material to bond first and second spaced transverse strands to the longitudinal strands at the crossing points of the strands; strand drawing means for drawing strand material to form the first and second transverse strands transversely across the plurality of longitudinal strands, the first transverse strand upstream and the second downstream of the die assemblies; and strand feed means adapted to move the first and second transverse strands taken from such material laterally into the respective rows of die assemblies from opposite directions.

Greater lengths of netting can be produced in each cycle if more than two rows of die assemblies are provided. In such a case it is preferred that the rows should be arranged in spaced pairs, each pair to be supplied with transverse strands from opposite directions as just described.

Preferably the strand feed means comprises two separate sets of co-operating arms for the first and second transverse strand, each arm bearing a strand gripper and being rotatable about pivot, and each set of arms being dimensioned and arranged to act together whereby the grippers are movable between a position in which the respective transverse strand provided by the drawing means can be gripped and a position in which the strand can be released in the respective row of die assemblies ready for moulding.

The die assemblies of the apparatus according to this invention may be similar to the die assemblies and means for injecting or introducing the heated plastics material described in my two specifications mentioned previously.

The strand drawing means may comprise separate drawing means for the two transverse strands. It is then preferred that they each comprise a gripper which draws the free end of the strand from a spool across the longitudinal strands to a position where the strand may be taken up by the feed means and fed laterally to the die assemblies. A cutter is provided to cut the strand at a convenient stage in the cycle of operations, usually before the strand is moved by the feed means towards the dies.

In accordance with a further aspect of this invention apparatus for making netting in the manner referred to employs means for advancing the longitudinal strands which comprises first and second sets of grippers for the strands the sets being spaced respectively upstream and downstream of the die assemblies and the grippers adapted to be moved together between a gripping position (in which a strand is gripped) and a retracted position in which the strand is released, and third and fourth sets of grippers similarly spaced and adapted to be moved together between a gripping position and a retracted position in which the grip is released and also reciprocable together between positions spaced along the length of the machine.

It will be apparent that it is possible to secure the desired advancing movement by appropriate synchronized reciprocating movement of all four sets of grippers, the first and second sets moving together and the third and fourth sets moving together. In the preferred apparatus, however, one pair of sets (which may be identified with the first and second sets) has no bodily movement along the machine and the reciprocating movements are confined to one pair (which may be identified with the third and fourth sets).

It is also preferred that the third and fourth sets of grippers are together reciprocable between positions where the third and fourth sets are upstream of the first and second sets respectively and positions where they are downstream thereof. Synchronized cyclical movement of the grippers can then ensure that the longitudinal strands are always maintained under tension, and that a constant length of the strands is advanced in each cycle, without alteration of tension, by the simultaneous movement of the second and fourth sets of grippers along the machine.

The strands may be wholly of thermoplastic material, as for example in the case of cargo or spots netting, or may include metal filaments as in the case of netting for electrified fences. The problems mentioned above concerning the difficulties previously encountered with multiple moulding assemblies are particularly relevant to netting of small mesh. In the apparatus according to the present invention the minimum distance between strands need only depend on the size of the die assemblies since the drawing and feed means may be displaced to either side of the pair of rows of die assemblies.

It is preferred that strand diverting means to counteract any contraction of the transverse strands on bonding are included in the apparatus. Such means may be similar to the thread diverting means described in British Pat. No. 1,321,229. It is also preferred to include between the rows of die assemblies strand diverting means to counteract any contraction of the longitudinal strands on bonding.

The invention will now be described further by way of example with reference to apparatus for use in the construction of nets. In this apparatus the strand feed means comprises two sets of co-operating arms, while the strand drawing means comprises separate drawing means for the two transverse threads.

Reference in the description will be made to the drawings in which.

Figure 1:
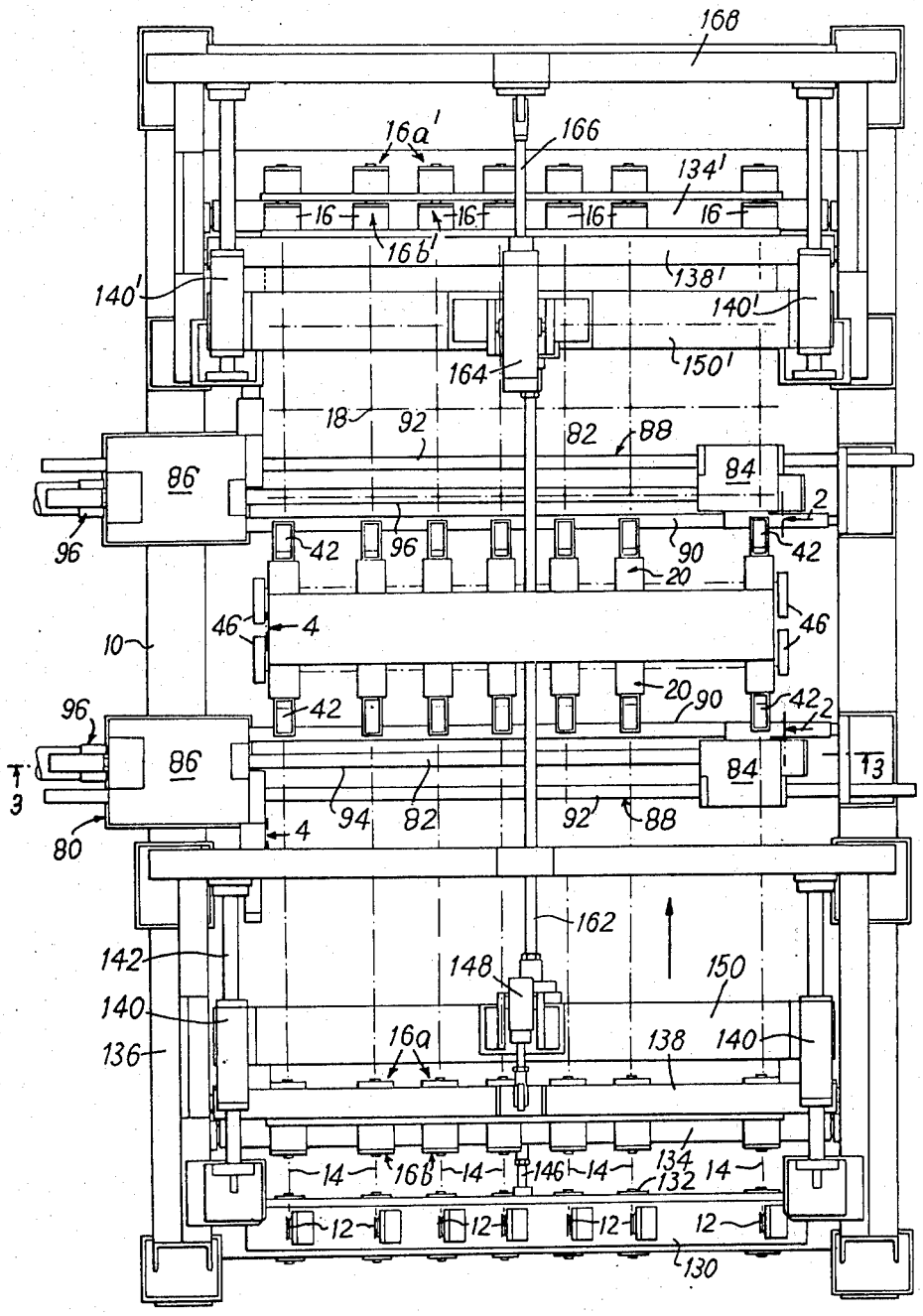
FIG. 1 is a plan view of the apparatus embodying the invention.

In the machine shown in the drawings the essential parts are borne on a frame 10. Feeds 12 for the longitudinal strands 14 are disposed at one end of the frame 10, while take-up means 16 in the form of grippers for the finished netting 18 is provided at the other end.

Figure 2:
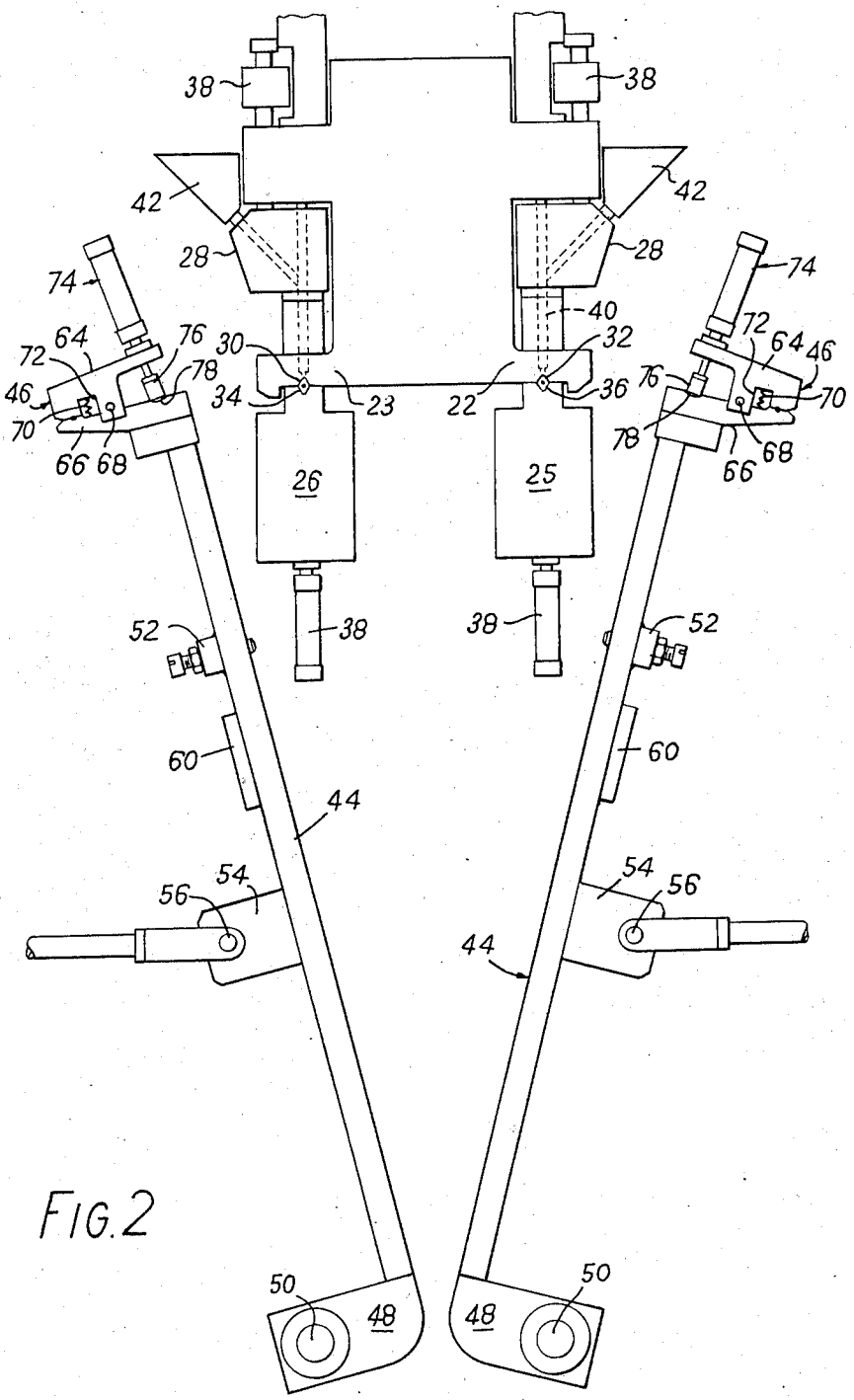
FIG. 2 is a vertical section of the die assemblies of the apparatus of FIG. 1 taken along the line 2—2 of FIG. 1 together with the strand feed means displaced from the position shown in FIG. 1.

Two rows 20 of die assemblies are disposed across the middle of the frame and comprise (as shown in FIG. 2) upper dies 22 and 23, lower dies 25 and 26 and associated injectors 28. The upper dies 22 and 23 have cavities 30, 32 corresponding to cavities 34, 36 in the lower dies. Pistons 38 are provided for actuation of the dies. The injectors 28 each include a heated barrel 40, a feed hopper 42 for granular thermoplastic, and hydraulic mechanism (not shown) for actuating a piston in the barrel 40.

Figure 4:
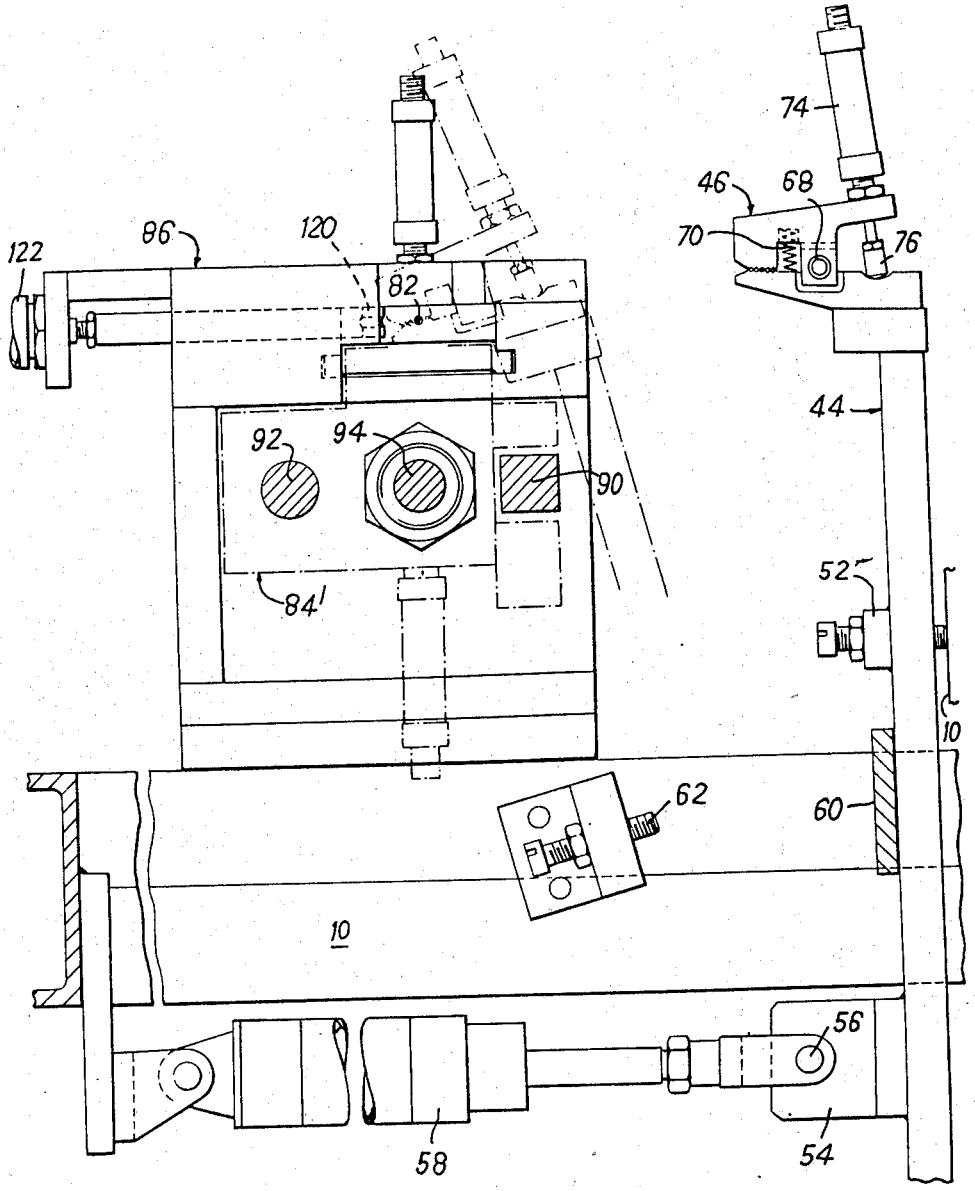
FIG. 4 is a vertical section of part of the drawing means and feed means of FIG. 1 taken along the line 4—4 of FIG. 1 and along the line 4′—4′ of FIG. 3.

The strand feed means comprises two pairs of co-operating arms. The arms for respective rows of die assemblies are disposed at either end thereof. As shown in FIGS. 2 and 4, each arm 44 includes a strand gripper 46 (also to be seen in FIG. 1), at its upper end, and a flange 48 with associated axle 50 at its lower end. The axle 50 is connected to the frame 10 and thus forms a pivot about which the arm 44 rotates. Rotation past the vertical is prevented by a stop 52. Each arm is provided with a second flange 54 and associated axle 56 which serves to connect the arm to a pneumatic system 58, which is connected to the frame 10. The two arms of a pair of co-operating arms are linked together by a cross-member 60. A stop 62 on the frame 10 limits rotation of the arm about the axle 50 on actuation of the pneumatic system 58. Each strand gripper 46 comprises an upper jaw 64 and a lower jaw 66. The two jaws are connected by an axle 68. A spring 70 disposed in a cavity 72 in the upper jaw 64 bears on the lower jaw 66 and tends to prise apart the faces of the jaws that grip the strand. A pneumatic system 74 on the upper jaw 64 has a piston 76 which may be actuated to bear on a depression 78 in the lower jaw 66 and force the faces of the jaws together.

Figure 3:
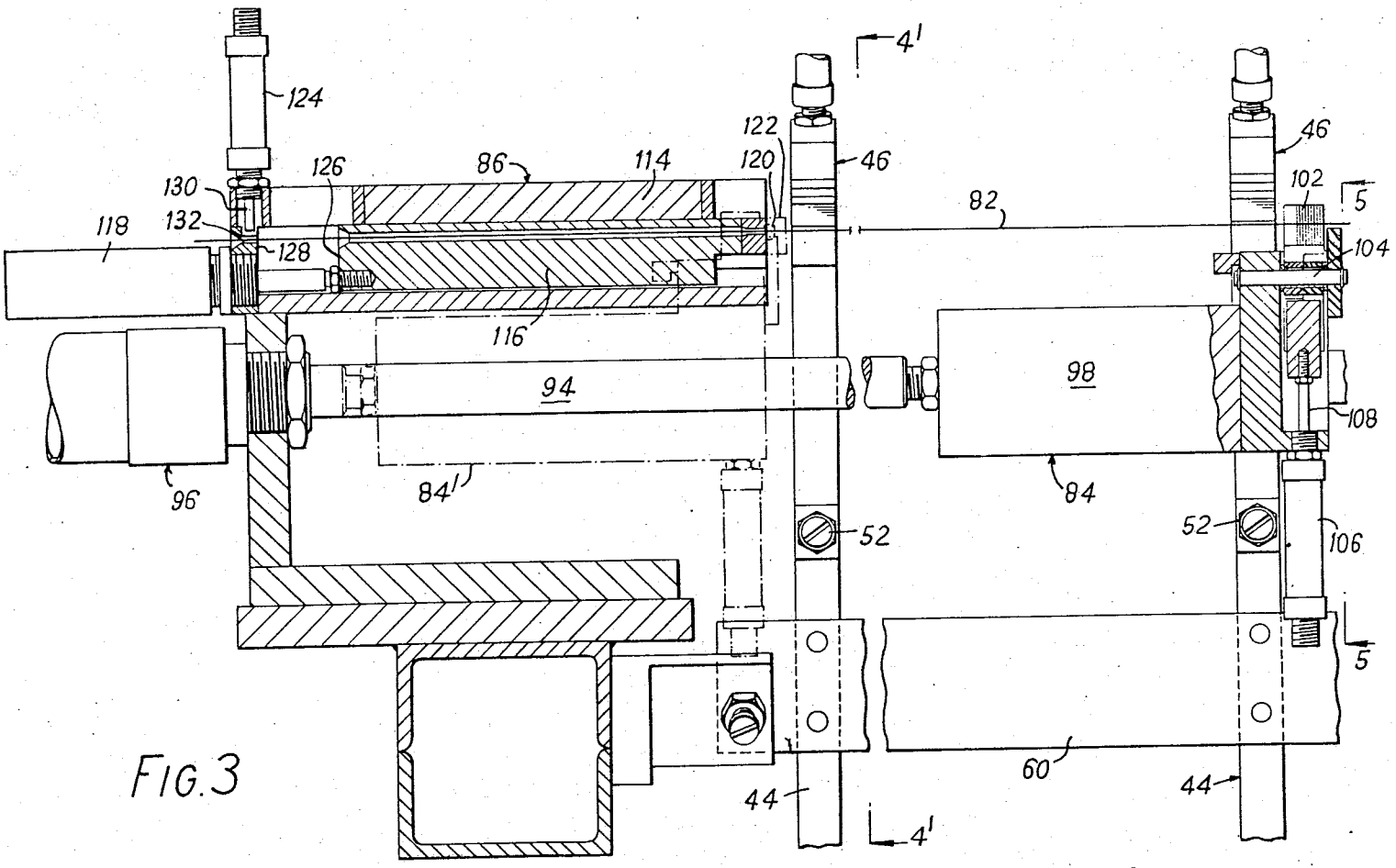
FIG. 3 is a vertical section of one of the separate drawing means of the apparatus of FIG. 1 taken along the line 3—3 of FIG. 1.

The strand drawing means comprises two similar drawing means 80 for two transverse strands 82. As shown especially in FIGS. 3 and 5, each drawing means 80 includes a travelling gripper 84 and a take-up station 86. Extending parallel to the associated row 20 of die assemblies is a track 88 comprising a square section guide member 90 and a round section guide member 92. The travelling gripper 84 travels on this track 88, and is propelled therealong by a piston 94 actuated by a pneumatic system 96 disposed adjacent the take-up station 86.

The travelling gripper has a main body 98, two jaws 100, 102, and axle 104 joined to the body 98 and about which the jaws 100, 102 may pivot, and a pnuematic system 106 with associated piston 108. The head of the piston 108 is shaped (see FIG. 5) such that on actuation it tends to force together the faces of the jaws that grip the strand. Springs 110 disposed in cavities 112 of the body 98 tend to prise the faces apart.

The take-up station 86 has a feed spool (not shown) for the transverse strand 82. The main body 114 of the station 86 has a sliding carriage 116 through which the strand 82 passes. A pneumatic system 118 is provided to move the carriage 116. The take-up station also has a cutting blade 120 which is actuated by the pneumatic system 122, and a strand arrester mechanism 124.

In operation, each of the longitudinal strands is drawn from the respective feed 12 and through the respective die assembly of the pair of rows 20 of die assemblies, by the respective take-up means 16. The operation of the machine is essentially cyclic in nature and hence the operation of the machine hereafter will be described in terms of one complete cycle. The cycle will be described with particular reference to the drawing and bonding of one of the two transverse strands only, similar considerations applying equally to the other.

At the start of a cycle, the travelling carriage 116 is in its withdrawn position whereby the end face 126 thereof abuts the face 128 of the body 114. The travelling gripper 84 is housed in the take-up station 86, as shown by the chain dotted line 84' in FIG. 3, and has the faces of its jaws 100, 102 open. The strand arrester mechanism 124 is in its operative position whereby the piston 130 is extended and holds the strand from the feed spool against the face 132 of the body 114. The strand extends through the carriage 116 and has an exposed free end in the vicinity of the blade 120. The pairs of co-operating arms 44 are in the vertical position as shown by the solid lines of FIG. 4 and as shown in FIG. 1 and have the faces of their jaws 64, 66 open. The upper dies 22 and 23 and lower dies 25 and 26 are in the closed or moulding position as shown in FIG. 2.

On commencement of a cycle, the dies are opened by actuation of the pistons 38. Simultaneously the jaws 100, 102 of the respective travelling gripper 84 grip the free end of the respective strand. The netting 18 is advanced by the take-up means 16, the strand arresting mechanism 124 releases the strand, and the pneumatic mechanism 96 operates to extend the piston 94 so as to cause the travelling gripper 84 to run along the track 88 to the opposite side of the frame 10. In so travelling the gripper 84 draws a length of strand 82 from the feed spool across the longitudinal strands. The pair of co-operating arms 44 are then rotated by operation of the pneumatic system 58 to the position shown in chain dotted line in FIG. 4. The faces of the jaws 64, 66, are then closed by extension of the piston 76 to grip the strand 82, the piston 130 of the strand arrester mechanism 124 is extended to hold the strand against the face 132 of the body 114, and the cutting blade 120 is then actuated to cut the strand. The travelling carriage 116 is then withdrawn to leave the free end of the strand exposed for the next cycle. The length of transverse strand thus gripped by the grippers 46 is then fed to the respective row 20 of die assemblies by rotation of the pair of co-operating arms. The dies then close, the grippers 46 release the strand, and a mass of plastics material is moulded and bonded at each crossing point.

Figure 6:
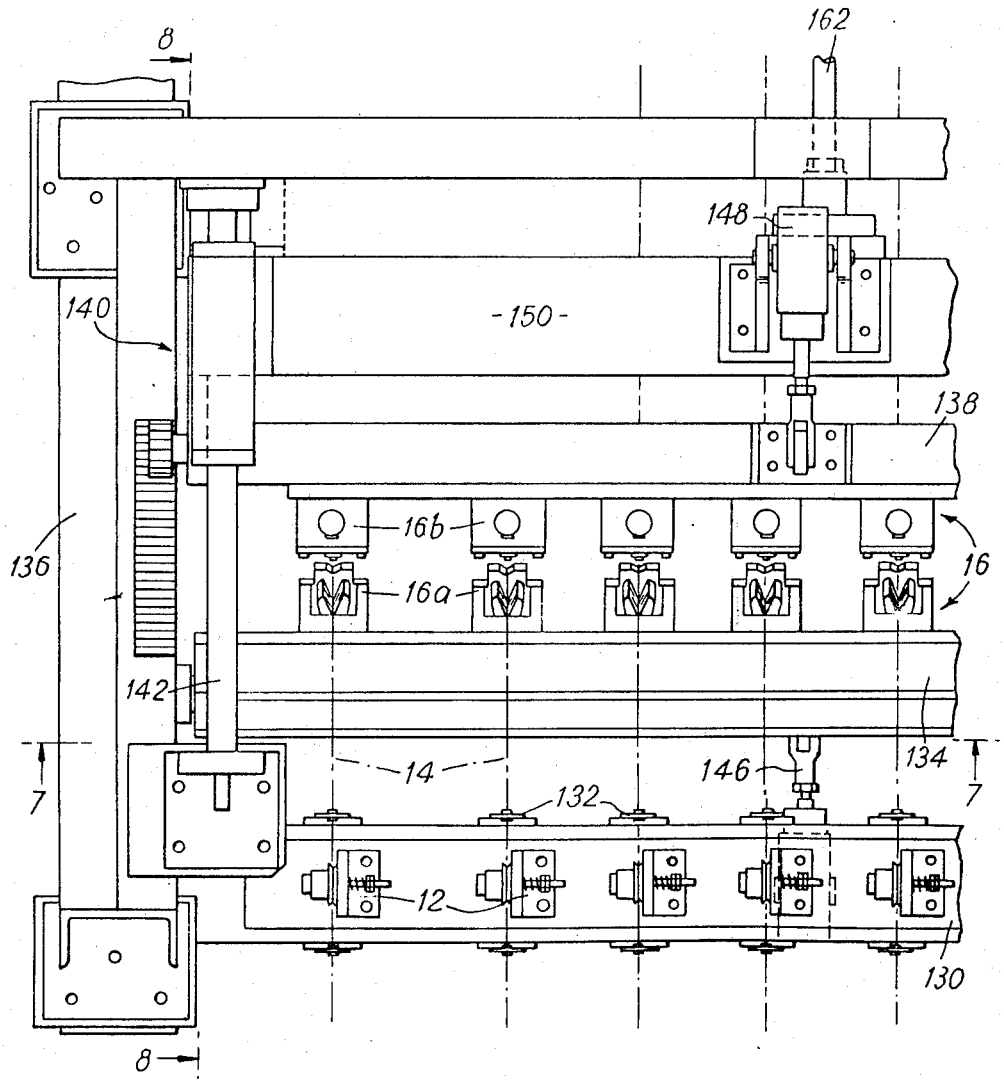
FIG. 6 is an enlarged plan view of one corner of the apparatus shown in FIG. 1.

The feed and longitudinal thread and net advancing means will be described by reference to FIGS. 6 to 8, which show in greater detail the mechanism at the feed end of the machine, although at a different point in the cycle from FIG. 1. Much of the equipment is duplicated at the take-off end, as will become apparent.

On a cross-member 130 of the frame of the machine are mounted feed devices 12 in the form of adjustable spring-loaded thread tensioners through which the strands 14 are drawn from a supply thereof. After passing through guide eyes 132 mounted on the same cross-member, the strands reach two sets of grippers 16 similar to the grippers constituting the take-up means 16 at the other end of the machine.

The grippers 16 are arranged in two sets, a lower set **16*a* mounted on a lower beam 134 extending across the machine below the level of the strands and pivotally mounted in the side members 136 of the main frame of the machine, and an upper set 16*b* mounted on an upper beam 138 which extends across the machine above the level of the strands and is pivotally mounted on carriages 140 which are themselves slidable along fixed bearing rods 142 extending above and parallel to the side members 136 of the frame. The lower set 16*a* corresponds to the "first set of grippers" mentioned above, and the upper set 16*b*** corresponds to the "third set of grippers" so mentioned.

The lower beam 134 is pivotable by the action of a fluid-actuated ram 144 mounted on the cross-member 130, through a connecting rod 146. In the retracted position, as shown in FIGS. 6 to 8, the grippers are below and out of engagement with the strands 14. The upper beam 138 is similarly pivotable by a ram 148 mounted on a cross-member 150 extending between the carriages 140, by which the grippers **16*b* can be retracted upwards out of engagement with the strands 14. As shown in FIGS. 6 to 8, however, the grippers 16*b*** are in the gripping position about the strands.

Figure 5:
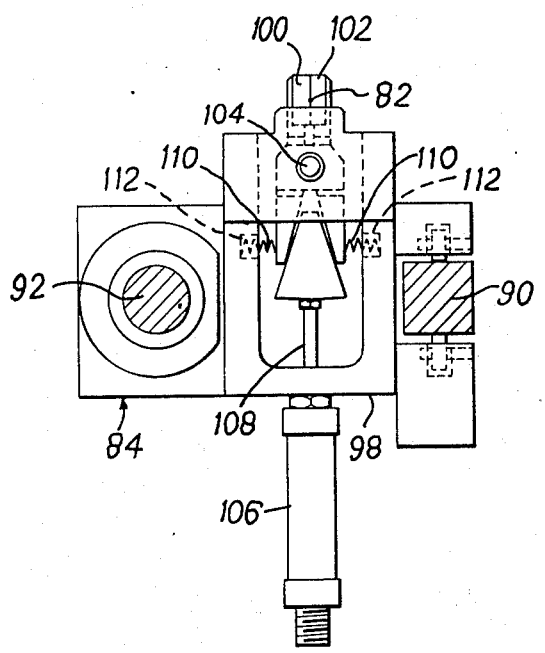
FIG. 5 is a vertical section of part of the drawing means of the apparatus of FIG. 1 taken along the line 5—5 of FIG. 1.
Figure 7:
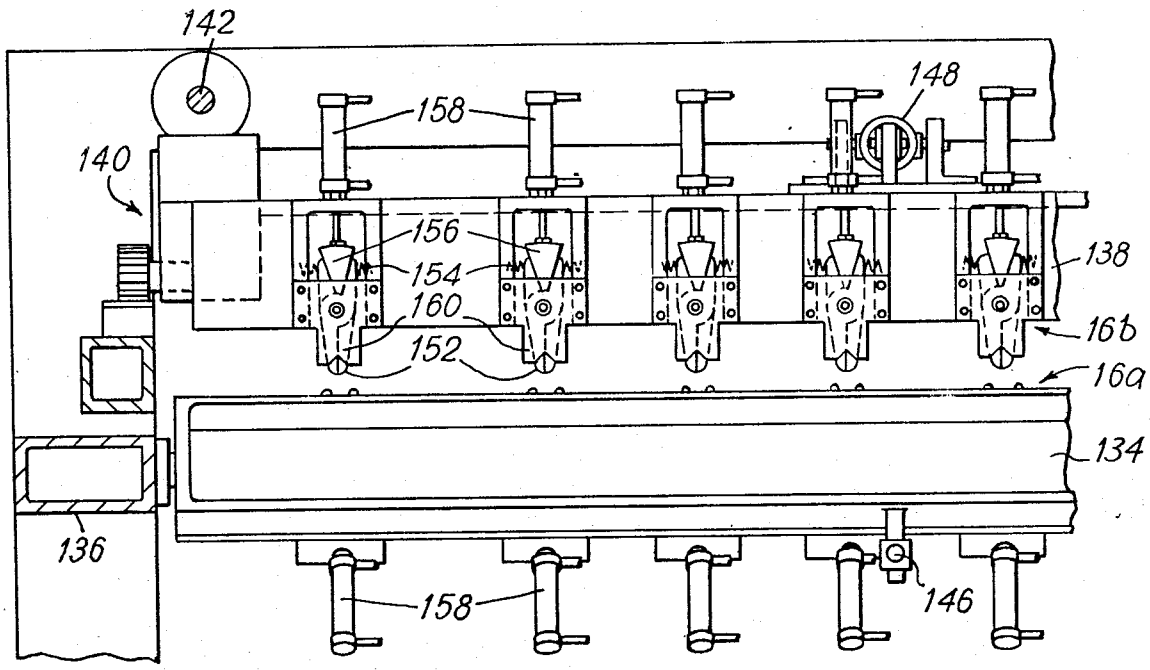
FIG. 7 is a vertical cross-section of the same corner of the apparatus along the line 7—7 in FIG. 6.
Figure 8:
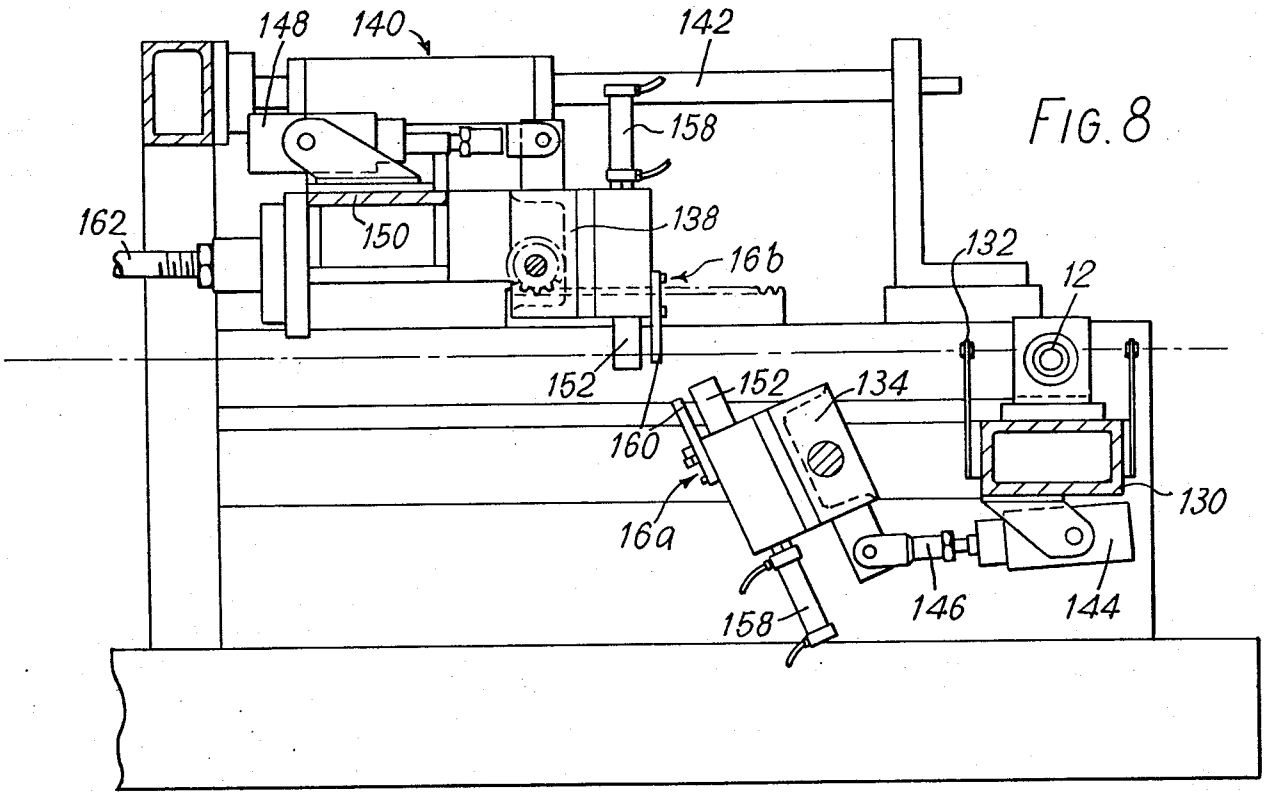
FIG. 8 is a vertical longitudinal section along the line 8—8 in FIG. 6.

The individual gripper 16 are best seen in FIG. 7 and are substantially identical to one another and also similar to that shown in FIG. 5. In grippers 16, scissor-mounted jaws 152 are biased to the closed position by compression springs 154 and the jaws are opened by a wedge 156 connected to an individual fluid-actuated ram 158 on each gripper. The pressure lines which lead from these and other rams to the timing controls and pressure fluid source (not shown) are omitted in the interests of clarity. Vee-guides 160 are also provided on the grippers at the feed end of the machine.

The carriages 140 at the feed end of the machine, which bear the upper pivotable beam 138, are linked to a similar pair of carriages 140' at the take-off end by a link rod 162 connecting the cross-member 150 with a similar cross-member 150' extending between the pair of carriages at the other end of the machine, as can be seen in FIG. 1. The two pairs of carriages and their attachments are thus reciprocable together and this movement is supplied by a further fluid-actuated ram 164 which can be seen in the upper part of FIG. 1. This ram is mounted on the cross-member between the carriages at the take-off end of the machine and its piston rod 166 is connected to a fixed cross-member 168 of the frame at that end of the machine.

It will be seen from FIG. 1 that the griper mechanism at the take-off end of the machine is largely similar to that at the feed end. However, in the apparatus shown in FIG. 1 the arrangement is not entirely symmetrical in that, whereas the lower grippers **16*a* at the feed end are on the downstream side of the lower beam 134 and the upper grippers 16*b* on the upstream side of the upper beam 138, the lower grippers 16*a'* at the take-off end (which constitute the "second set" mentioned above) are on the downstream side of the lower beam 134' at that end and the upper grippers (the "fourth set") on the downstream side also of the upper beam 138' at that end. This lack of symmetry is not significant, however, although it is preferred that, whatever the direction in which a given set of grippers faces, a set of grippers at each end of the machine should be reciprocable between positions in which they are at one extreme upstream of and at the other extreme downstream of the other set of grippers at the respective ends of the machine. Furthermore, devices which would interfere with the free movement of the transverse strands of the formed net, such as the guides 132**, are not fitted at the take-off end.

In operation, the strands 14 are gripped by the upper grippers at each end of the machine, namely the "third set" (16*b*) and the "fourth set" (16*b'*), in their upstream position, while held under tension by the lower grippers, namely the "first set" (16*a*) and the "second set" (16*a'*). Thereafter, the lower grippers disengage and the strands are advanced by simultaneous movement of the upper grippers to their downstream position. At this point the lower grippers re-engage the strands, maintaining the desired tension and position, whereafter the upper grippers are disengaged and returned to their upstream position for a fresh cycle.

The longitudinal strands and formed net are thus advanced intermittently under conditions of constant tension, and irregularities in the product can thereby be minimized. Moreover, the strands at the time of moulding are held at constant length so that variations in contraction due to the moulding operation do not result in distortion of the configuration of the netting.

It is, however, possible satisfactorily to manufacture netting without positive feed of the longitudinal strands in fixed lengths in the manner described, especially with a relatively short machine, as for example where one row of the die assemblies 20 is omitted and only a single row of bonds applied per cycle. For such a simplified advancing mechanism, the gripper mechanism at the feed end, as shown in FIGS. 6 to 8, can be omitted and only the tensioners 12 retained. Nevertheless there is still advantage in utilizing the co-operating sets of upper and lower grippers as take-off means because with this arrangement the longitudinal threads are kept under tension throughout the operation, not being released by one set of grippers until they have already been gripped by the other set.

The movements of the strands are synchronized with the moulding operations, as already described above in general terms. As regards the specific movements of the mechanism described with reference to FIGS. 6 to 8, whether provided at both ends of the machine or at the take-off end only, one preferred cycle of operations may be briefly outlined as follows.

Firstly, the upper grippers are lowered onto and grip the longitudinal strands 14, which are already held by the lower grippers. Thereafter the dies 20 which have remained closed from the previous moulding operation, open, the transverse strand feed means releases the transverse strand or strands inserted in the previous cycle and moves out to take up fresh transverse strand material already in position. The lower grippers relax and retract and the upper grippers move along the machine direction until a fresh length of the longitudinal strands lies in the die assemblies. The transverse strand feed means moves the fresh material for such strands into the dies and the travelling gripper of the transverse strand drawing means returns to draw a new length of strand material.

With the longitudinal and transverse strands in position and stationary, the dies close and the bonding buttons are moulded. The lower grippers then move into engagement with and grip the longitudinal strands after which the upper grippers relax and withdraw and are moved back, in their reciprocating motion, to the starting point. Meanwhile the travelling gripper of the strand drawing means moves across the machine, drawing fresh transverse strand material into position for the next cycle.

I claim:

1. Apparatus for producing rectilinear netting which comprises: means for advancing a plurality of spaced longitudinal strands in a downstream direction; a pair of transverse rows of die assemblies for moulding individual masses of plastics material to bond first and second spaced transverse strands to the longitudinal strands at the crossing points of the strands; strand drawing means for drawing strand material to form the first and second transverse strands transversely across the plurality of longitudinal strands, the first transverse strand upstream and the second downstream of the die assemblies; and strand feed means adapted to move the first and second transverse strands taken from such material laterally into the respective rows of die assemblies from opposite directions.

2. Apparatus according to claim 1 wherein the strand feed means comprises two separate sets of co-operating arms for the first and second transverse strands, each arm bearing a strand gripper and being rotatable about a pivot, and each set of arms being dimensioned and arranged to act together whereby the grippers are movable between a position in which the respective transverse strand provided by the drawing means can be gripped and a position in which the strand can be released in the respective row of die assemblies ready for moulding.

3. Apparatus according to claim 1 wherein the strand drawing means comprise for each transverse strand a gripper which draws the free end of the strand from a spool across the longitudinal strands to a position where the strand may be taken up by the feed means and fed laterally to the die assemblies.

4. Apparatus according to claim 1 wherein the means for advancing the longitudinal strands comprises a corresponding number of grippers disposed on one side of the path of the longitudinal strands downstream from the die assemblies and adapted to be moved together between respective strand gripping positions and retracted positions in which the strands are released, and further corresponding grippers disposed on the opposite side of the path of the longitudinal strands downstream from the die assemblies and adapted to be moved together between respective gripping positions and retracted positions in which the grip is released, the said further grippers being also reciprocable together between a position where they are upstream of the first mentioned grippers and a position where they are downstream thereof.

5. Apparatus according to claim 1 wherein the means for advancing the longitudinal strands comprises first and second sets of grippers for the strands the sets being spaced respectively upstream and downstream of the die assemblies and the grippers adapted to be moved together between a gripping position and a retracted position in which the grip is released, and third and fourth sets of grippers similarly adapted to be moved together between a gripping position and a retracted position in which the grip is released and also reciprocable together between positions where the third and fourth sets are upstream of the first and second sets respectively and positions where they are downstream thereof.

6. Apparatus for producing rectilinear netting which comprises: means for supplying a plurality of spaced longitudinal strands; means for supplying at least one transverse strand; means for placing said transverse strand in a position extending across said longitudinal strands to form a mesh therewith; at least one transverse row of die assemblies disposed in the paths of said longitudinal and transverse strands for moulding individual masses of plastics material about the crossing of said strands; first and second sets of grippers each corresponding in number to said strands the sets being spaced respectively upstream and downstream of the die assemblies and the grippers adapted to be moved together between a gripping position and a retracted position in which the grip is released, and third and fourth sets of grippers similarly adapted to be moved together between a gripping position and a retracted position in which the grip is released and also reciprocable together between positions where the third and fourth sets are upstream of the first and second sets respectively and positions where they are downstream thereof.

* * * * *